US008162061B2

(12) United States Patent
Maxwell

(10) Patent No.: US 8,162,061 B2
(45) Date of Patent: Apr. 24, 2012

(54) SUBSEA INFLATABLE BRIDGE PLUG INFLATION SYSTEM

(75) Inventor: David W. Maxwell, New Caney, TX (US)

(73) Assignee: Baker Hughes Incorporated, Houston, TX (US)

( * ) Notice: Subject to any disclaimer, the term of this patent is extended or adjusted under 35 U.S.C. 154(b) by 402 days.

(21) Appl. No.: 12/102,002

(22) Filed: Apr. 13, 2008

(65) Prior Publication Data

US 2009/0255680 A1 Oct. 15, 2009

(51) Int. Cl.
*E21B 7/12* (2006.01)

(52) U.S. Cl. ..... 166/339; 166/285; 166/177.4; 166/368

(58) Field of Classification Search ..... 166/338, 166/339, 360, 378, 381, 106, 179, 368, 121, 166/97.1, 75.1; 114/296
See application file for complete search history.

(56) References Cited

U.S. PATENT DOCUMENTS 3,314,240 A * 4/1967 Bardgette ..... 405/228
4,246,964 A * 1/1981 Brandell ..... 166/106
4,573,532 A * 3/1986 Blake ..... 166/264
4,787,446 A * 11/1988 Howell et al. ..... 166/66.6
4,936,387 A * 6/1990 Rubbo ..... 166/387
5,133,412 A * 7/1992 Coronado ..... 166/381
5,228,519 A * 7/1993 Coronado et al. ..... 166/387
5,271,469 A * 12/1993 Brooks et al. ..... 166/387
5,273,109 A * 12/1993 Arizmendi et al. ..... 166/123
5,287,741 A * 2/1994 Schultz et al. ..... 73/152.51
5,404,946 A * 4/1995 Hess ..... 166/187
5,445,476 A * 8/1995 Sgouros et al. ..... 405/224
5,458,194 A * 10/1995 Brooks ..... 166/285
5,803,186 A * 9/1998 Berger et al. ..... 175/50
6,009,951 A * 1/2000 Coronado et al. ..... 166/387
6,167,831 B1 * 1/2001 Watt et al. ..... 114/322
6,182,755 B1 * 2/2001 Mansure ..... 166/180
6,223,671 B1 * 5/2001 Head ..... 114/230.2
6,397,946 B1 * 6/2002 Vail, III ..... 166/250.01
6,435,279 B1 * 8/2002 Howe et al. ..... 166/336
6,464,011 B2 * 10/2002 Tubel ..... 166/313
6,474,416 B2 * 11/2002 Beall et al. ..... 166/343
6,615,923 B1 * 9/2003 Lay et al. ..... 166/368
6,675,888 B2 * 1/2004 Schempf et al. ..... 166/65.1
6,719,496 B1 * 4/2004 Von Eberstein ..... 405/224
6,763,889 B2 * 7/2004 Rytlewski et al. ..... 166/338
6,857,486 B2 * 2/2005 Chitwood et al. ..... 175/104
7,216,714 B2 * 5/2007 Reynolds ..... 166/338

(Continued)

OTHER PUBLICATIONS

Girola, G. and Cerrito, E., "Small Diameter Packers Can Solve Big Well Control Problems," SPE Paper No. 29927 (1995); 12 pages.

(Continued)

*Primary Examiner* — Thomas Beach
*Assistant Examiner* — Aaron Lembo
(74) *Attorney, Agent, or Firm* — Shawn Hunter

(57) ABSTRACT

A remotely operated submersible vehicle (ROV) is used to carry a bridge plug down to a sub sea well. The ROV is operated from a surface vessel or platform and is outfitted with a submersible hydraulic pump and a manipulator arm. Additionally, the ROV is provided with a carrying rack which can support a well closure assembly made up of an inflatable bridge plug and an affixed hydraulic running tool. The bridge plug and running tool are placed into the carrying rack and operably interconnected with the hydraulic pump so that the plug element can be selectively inflated by the pump.

12 Claims, 7 Drawing Sheets

U.S. PATENT DOCUMENTS

| | | | | |
|---|---|---|---|---|
| 7,314,084 | B2 * | 1/2008 | Rodrigues et al. | 166/344 |
| 7,325,598 | B2 * | 2/2008 | Bartlett | 166/75.13 |
| 7,325,628 | B2 * | 2/2008 | Brunning et al. | 175/8 |
| 7,380,609 | B2 * | 6/2008 | Page et al. | 166/387 |
| 7,621,338 | B2 * | 11/2009 | Wenham et al. | 166/343 |
| 7,661,905 | B2 * | 2/2010 | Alhayari | 405/224.1 |
| 7,677,320 | B2 * | 3/2010 | Shaw et al. | 166/368 |
| 2002/0066556 | A1 * | 6/2002 | Goode et al. | 166/53 |
| 2006/0231262 | A1 * | 10/2006 | Jacobsen et al. | 166/358 |
| 2008/0063478 | A1 * | 3/2008 | Reddy | 405/154.1 |
| 2010/0307760 | A1 * | 12/2010 | Shouse | 166/339 |

OTHER PUBLICATIONS

Kelbie, G.M. and Mackenzie, G., "Through-Tubing Inflatable Intervention Tools and Techniques in a Subsea Well Environment," SPE Paper No. 99360 (2006); 7 pages.

* cited by examiner

SUBSEA INFLATABLE BRIDGE PLUG INFLATION SYSTEM

BACKGROUND OF THE INVENTION

1. Field of the Invention

The invention relates generally to systems and methods for closing off sub sea wells.

2. Description of the Related Art

There are many instances when a sub sea wellbore must be closed in or sealed off to both protect the well and prevent chemicals and production fluids within the well from being dispersed into the sea. In some instances, the well reaches the end of its productive life and must be closed off. In other instances, the well must be closed down on a temporary basis. In addition, hurricanes and other storms can damage sea-based platforms, even removing them from their moorings. Sub sea risers can be destroyed during such storms. Storm-damaged sub sea wells must be capped off to limit harm to the environment. Currently, divers are used to submerge and cap off the wellbore manually.

SUMMARY OF THE INVENTION

The invention provides methods and devices for closing off sub sea wells. In a preferred embodiment, a remotely operated submersible vehicle (ROV) is used to carry a bridge plug down to a sub sea well. Preferably, the ROV is operated from a surface vessel or platform and is outfitted with a submersible hydraulic pump and a manipulator arm. Additionally, the ROV is provided with a carrying rack which can support a well closure assembly made up of an inflatable bridge plug and an affixed hydraulic running tool. The bridge plug and running tool are placed into the carrying rack and operably interconnected with the hydraulic pump so that the plug element can be selectively inflated by the pump.

In operation, the ROV is deployed into the sea from the surface vessel or platform. The ROV descends to the depth of the wellbore and deploys the well closure assembly into the open wellbore using one or more manipulator arms. The pump is actuated to inflate the plug element of the bridge plug and thereby close off the wellbore. The running tool releases from the bridge plug upon receipt of a predetermined amount of fluid pressure from the pump. Thereafter, the running tool is removed from the wellbore, and the ROV returns to the surface vessel.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
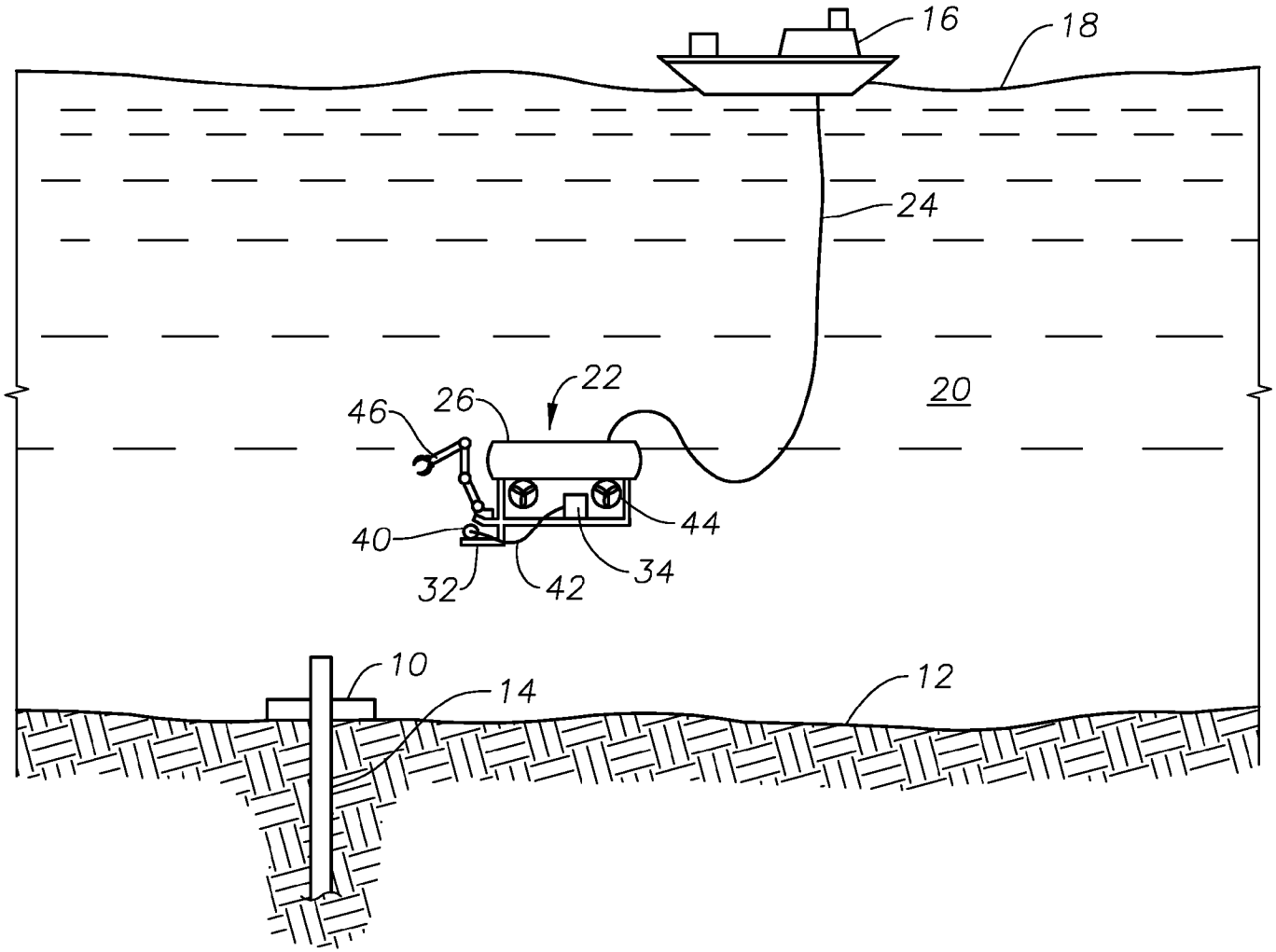
FIG. 1 is an external side view of an exemplary surface vessel, ROV and wellbore to be closed off in accordance with the present invention.

FIG. 1 illustrates an exemplary sub sea wellhead 10 on the sea floor 12. The wellhead 10 is shown in a greatly simplified and schematic manner, but includes a wellbore 14 which extends downwardly through the sea floor 12 and which it is desired to close off. A vessel 16 floats at the surface 18 of the sea 20 in the area generally above the wellhead 10. The surface vessel 16, which in this case is shown to be a ship, is provided with standard equipment needed for operation of a remotely operated vehicle (ROV).

A submersible ROV 22 is shown deployed within the sea 20. The ROV 22 is preferably a work class ROV. Suitable ROVs for this application include the TRITON® XLX ROV manufactured by Perry Slingsby Systems of 10642 West Little York, #100, Houston, Tex. 77041. The ROV 22 is interconnected with the surface vessel 16 by a control tether 24, of a type known in the art.

Figure 2:
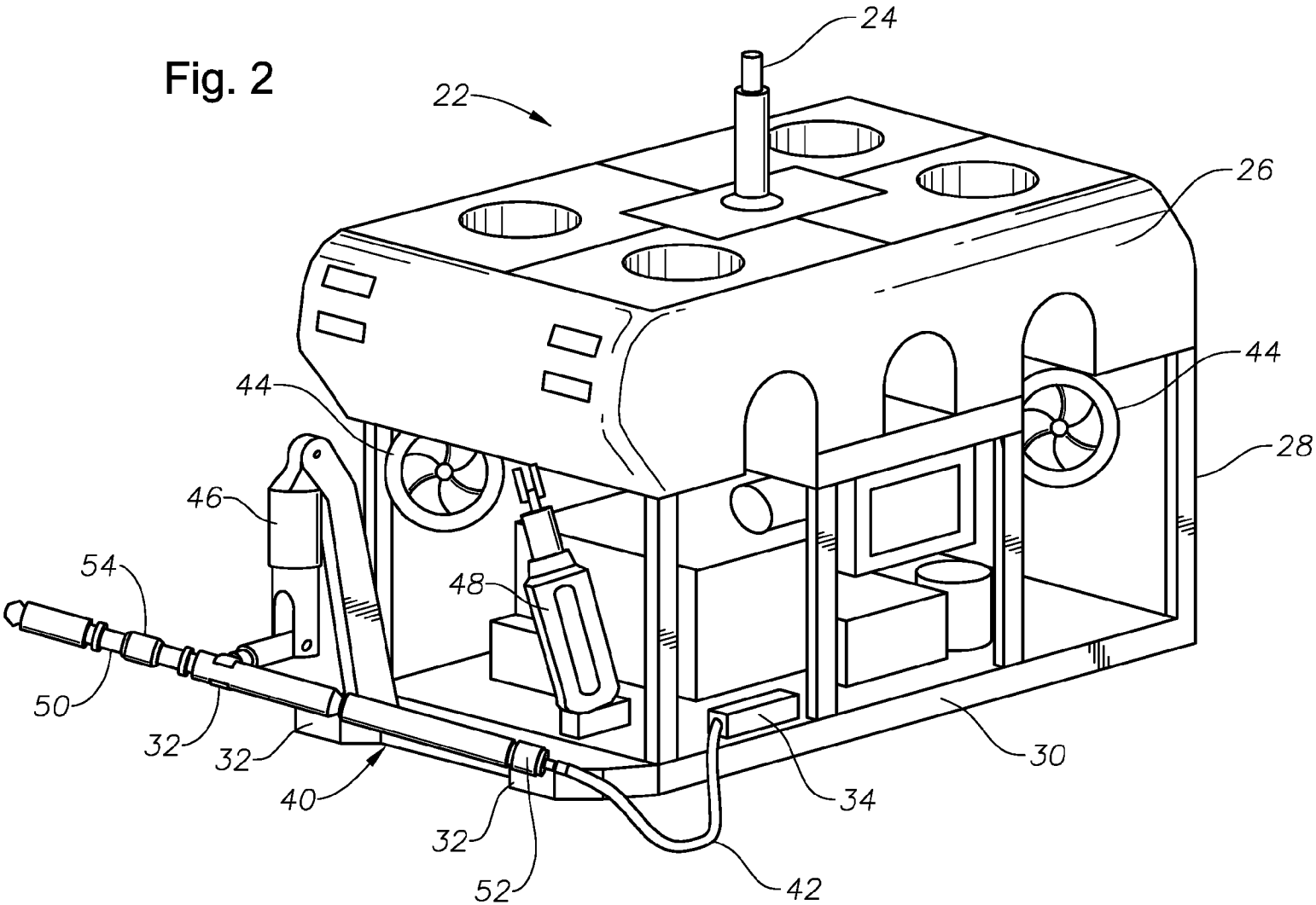
FIG. 2 is an external isometric view of the ROV in greater detail.
Figure 3:
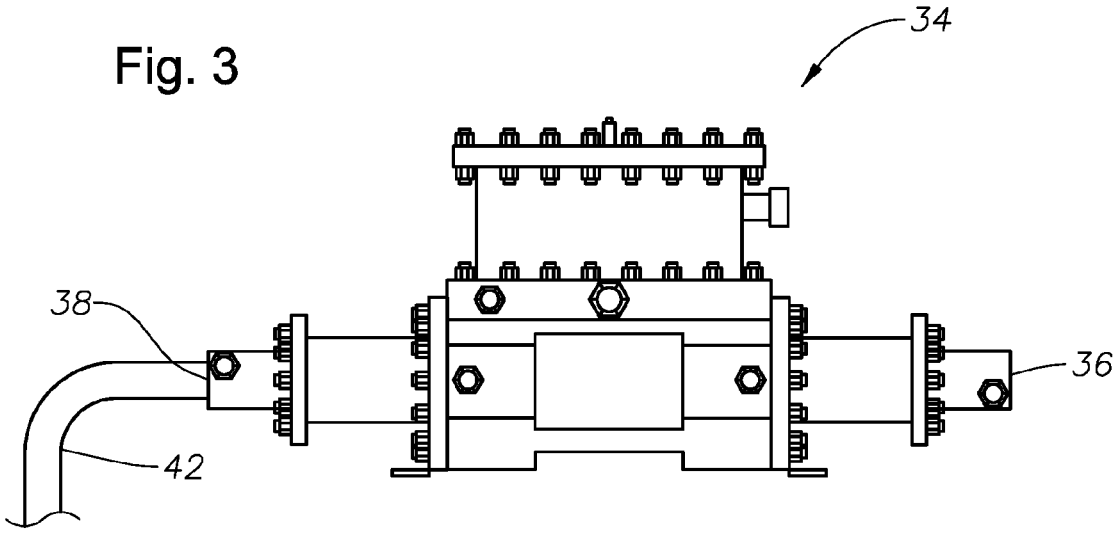
FIG. 3 is a side view of an exemplary fluid pump used in conjunction with the present invention.
Figure 4:
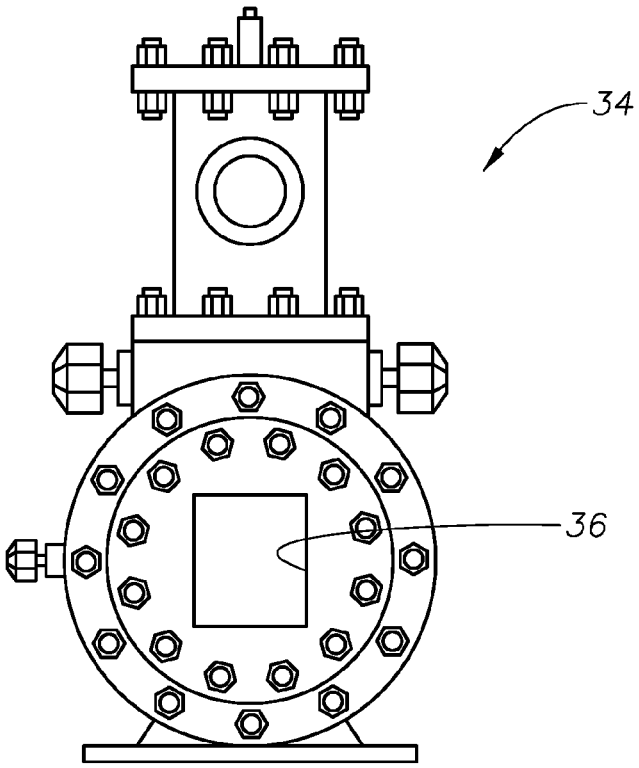
FIG. 4 is an end view of the exemplary fluid pump shown in FIG. 3.

As best shown in FIG. 2, the ROV 22 includes an upper flotation pack 26, as is known in the art. A metal support frame 28 depends from the flotation pack 26 and includes a tool sled 30. Sled extensions 32 are affixed to the tool sled 30. The tool sled 30 supports a submersible fluid pump 34. The fluid pump 34 is preferably operably interconnected with the control cable 24 to permit the pump 34 to be selectively actuated from the surface vessel 16. The fluid pump 34 is preferably fitted with sea water filters, as is known in the art. An exemplary fluid pump 34 is shown in greater detail in FIGS. 3 and 4. The pump 34 has a fluid inlet 36 and a fluid outlet 38. The fluid outlet 38 of the pump 34 is interconnected with a well closure assembly 40 via a fluid conduit 42, which, in turn, is interconnected with the fluid outlet 38 of the pump 34. The ROV 22 also includes propulsion thrusters 44 and manipulator arms 46, 48, as are known in the art.

Figure 8:
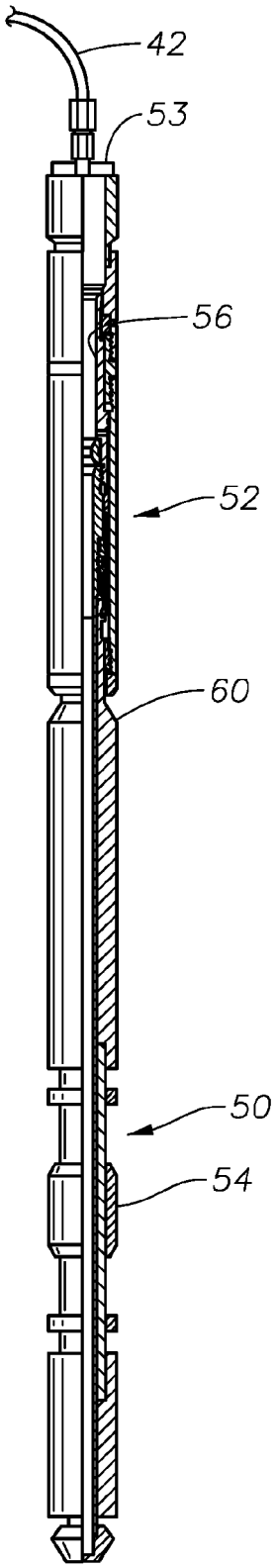
FIG. 8 is side, cross-sectional view of well closure assembly.
Figure 9:
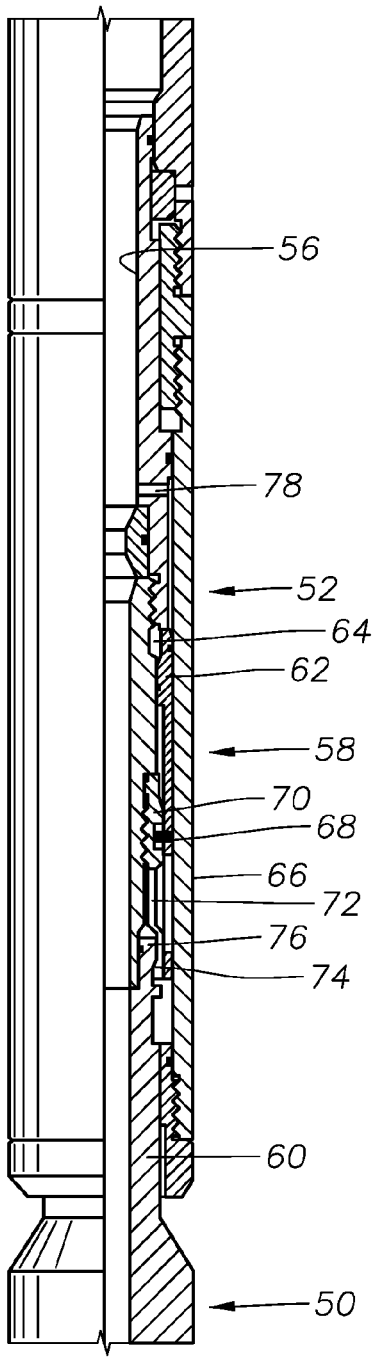
FIG. 9 is a side, cross-sectional view of upper portions of the well closure assembly.

The well closure assembly 40 includes an inflatable bridge plug 50 and a hydraulic disconnect running tool 52. The bridge plug 50 is of the type which includes an elastomeric sealing element 54 that is inflatable between and unset, radially reduced condition and a set, radially-enlarged condition via selective injection of fluid. A suitable bridge plug for use in this application is the Thru-Tubing Inflatable Retrievable Bridge Plug, which is available commercially from Baker Oil Tools of Houston, Tex. The running tool 52 is preferably a hydraulically-operated running tool, such as the "hydraulic disconnect" tool, which is also available commercially from Baker Oil Tools. The hydraulic disconnect running tool 52 will automatically release from the bridge plug 50 upon the application of a predetermined level of fluid pressure from the fluid conduit 42. FIG. 8 depicts the exemplary well closure tool 40 in side cross-section, and FIG. 9 illustrates the upper portions of an exemplary well closure assembly 40 to illustrate the manner in which the running tool 52 is releasably interconnected with the fluid conduit 42. A fitting 53 is used to operably interconnect the fluid conduit 42 with the running tool 52. The fitting 53 encloses the upper end of the central flowbore 56 within the running tool 52 to permit the flowbore 56 to be filled with fluid.

The running tool 52 is affixed by a releasable latching assembly, generally shown at 58, to a reduced diameter neck 60 of the bridge plug 50. The latching assembly 58 includes an annular piston 62 which is disposed within a piston chamber 64 within the housing 66 of the running tool 52. The piston 62 is initially affixed by a frangible shear pin 68 to an inner sleeve 70 of the running tool 52. The latching assembly 58 also includes a plurality of latching collet fingers 72, of a type known in the art, which extend axially downwardly from the inner sleeve 70 and present inwardly directed latching flanges 74 at their lower ends. The flanges 74 underlie a radially outwardly extending lip 76 on the neck 60 of the bridge plug 50. This engagement of the flanges 74 and lip 76 secures the running tool 52 to the bridge plug 50.

It is noted that a radial fluid passage 78 is formed within the inner sleeve 70 to permit fluid communication between the central flowbore 56 and the piston chamber 64. As a result, pressurized fluid within the flowbore 56 is communicated into the piston chamber 64 via the passage 78 and brought to bear upon the piston 62. The running tool 52 may be released from the bridge plug 50 by increasing fluid pressure within the flowbore 56 to a predetermined level that is sufficient to shear the shear pin 68 and shift the piston 62 axially downwardly within the chamber 64. When the piston 62 is shifted downwardly within the chamber 64, the collet fingers are freed to deflect radially outwardly and out of overlapping engagement with the lip 76.

Figure 5:
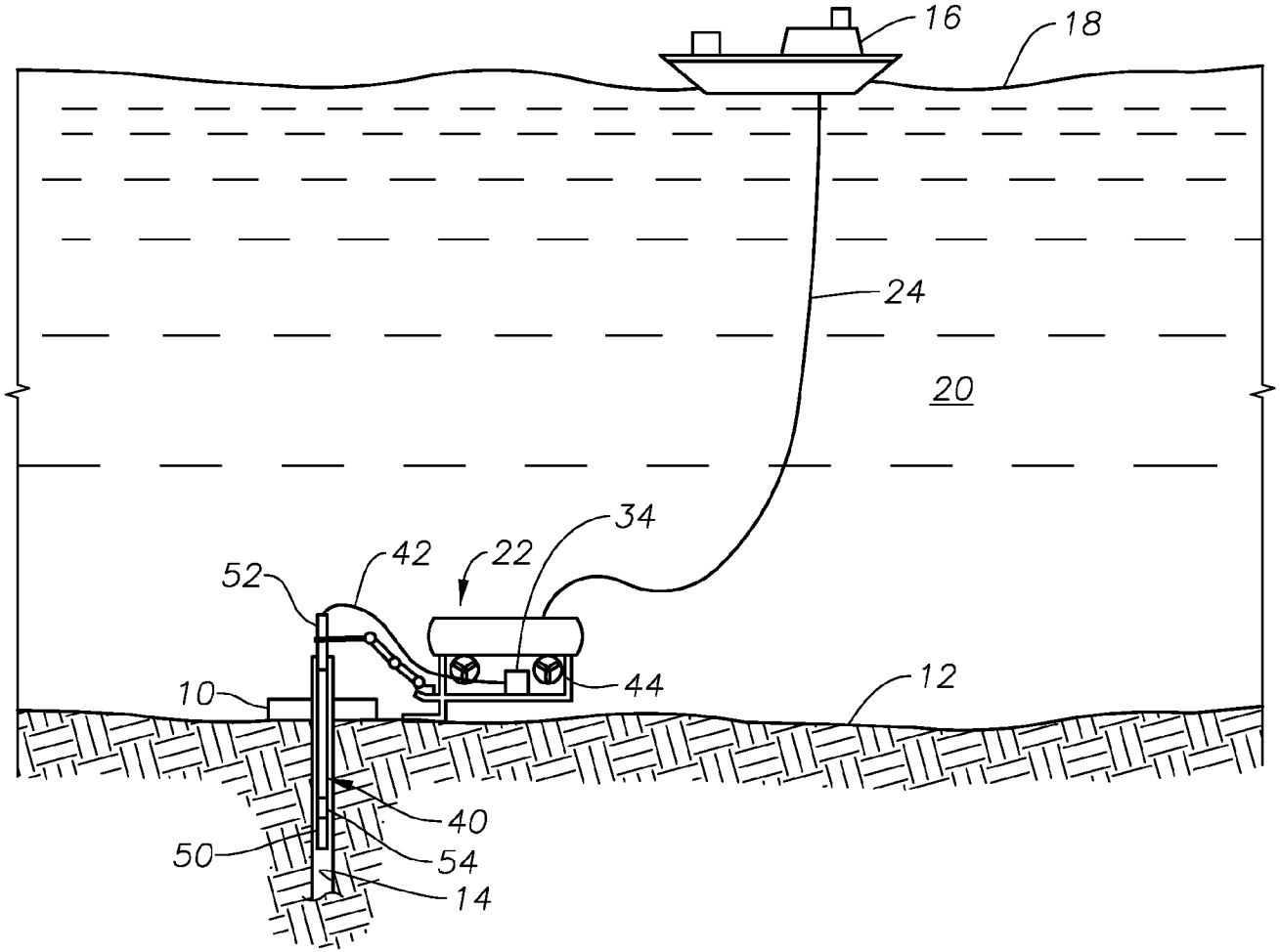
FIG. 5 is an external side view of the surface vessel, ROV and wellbore, now with the well closure assembly being inserted into the wellbore by the ROV.
Figure 6:
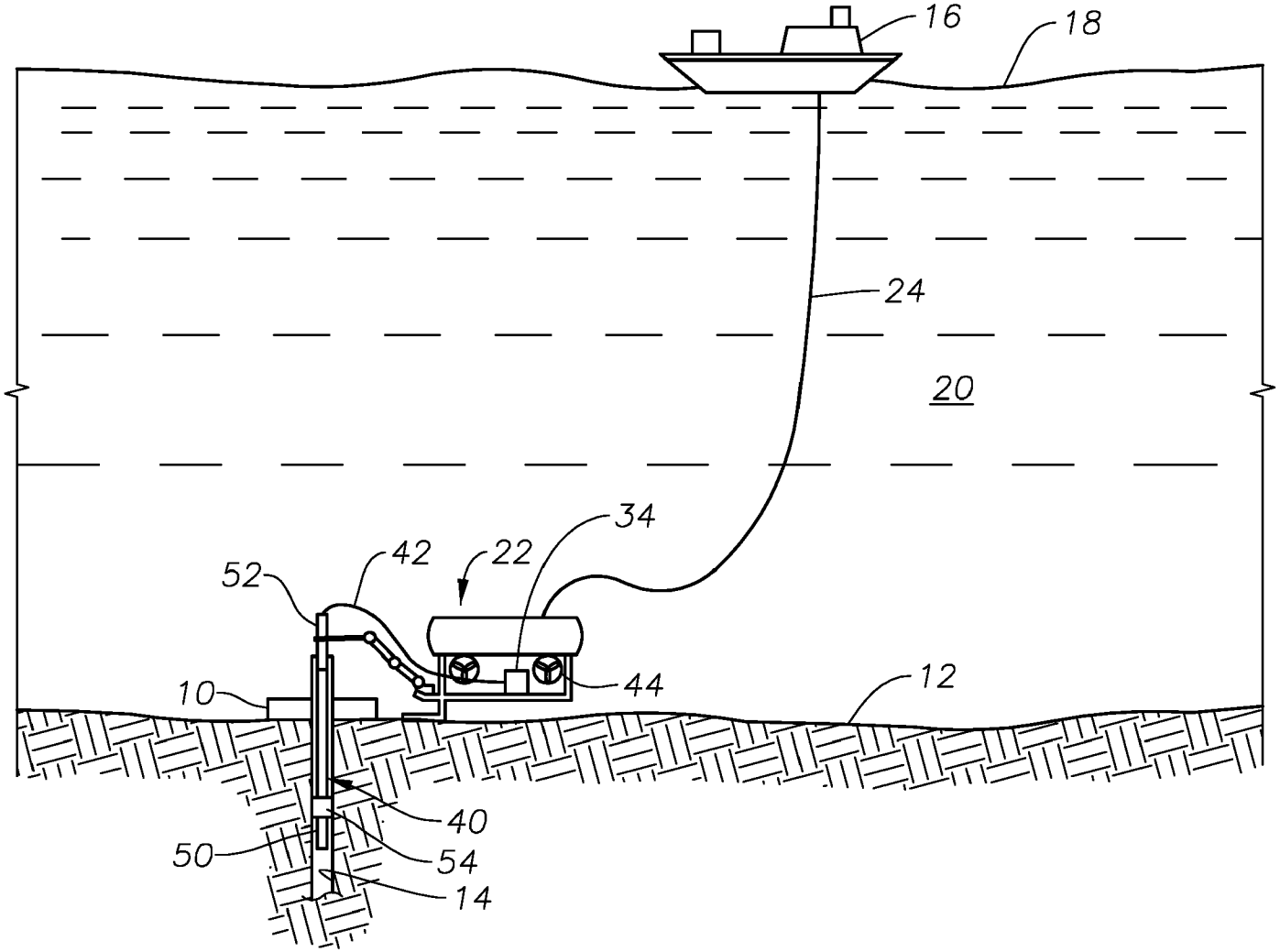
FIG. 6 is an external side view of the surface vessel, ROV and wellbore now with the packer device set within the wellbore.
Figure 7:
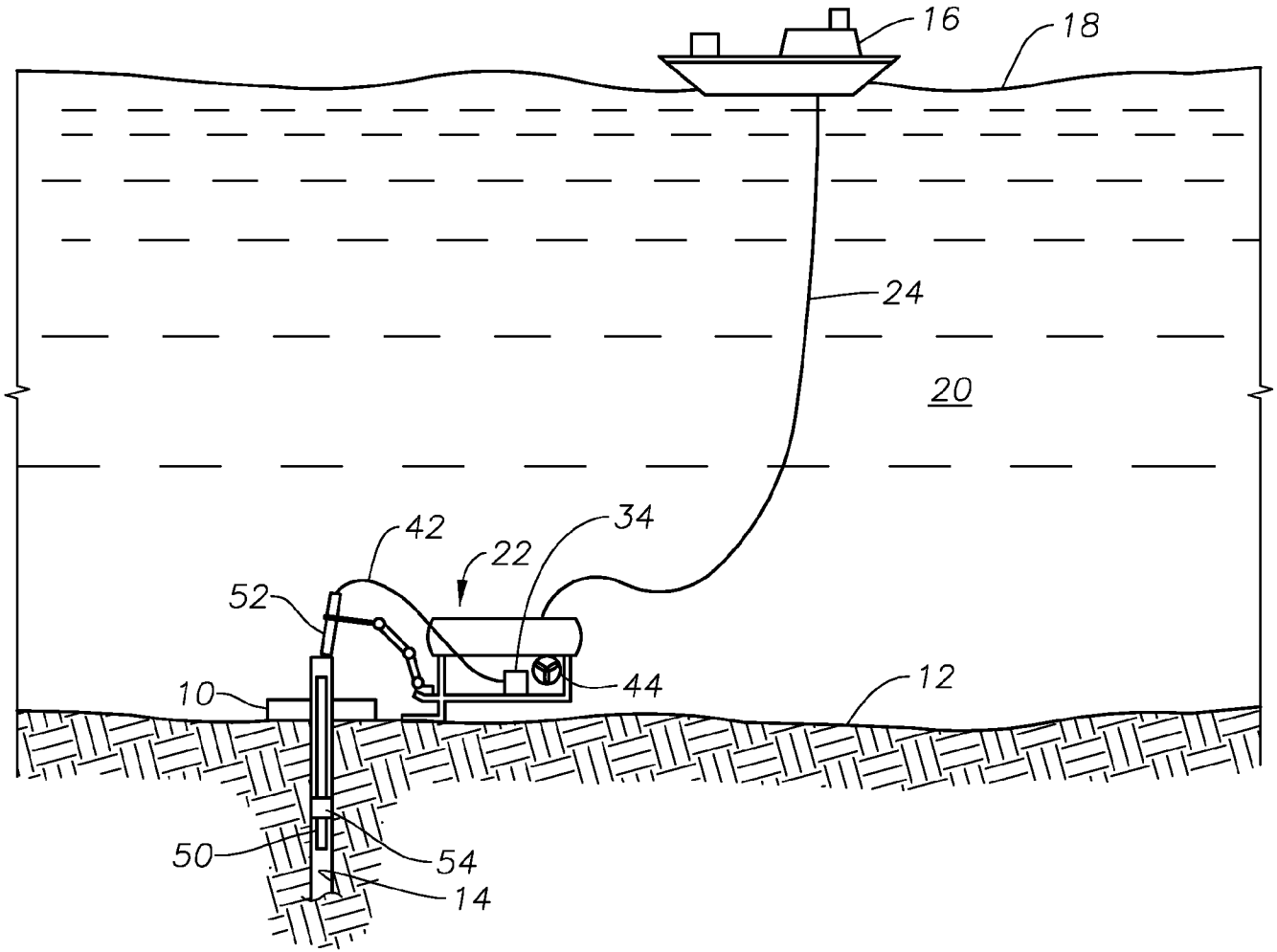
FIG. 7 is an external side view of the surface vessel, ROV and wellbore, now with the hydraulic disconnect device having been released from the bridge plug.

In operation the ROV 22 is deployed into the sea 20 from the surface vessel 16. The ROV 22 is guided to the wellhead 10. Thereafter, the ROV uses manipulator arms 46, 48 to remove the well closure assembly 40 from the sled extensions 32. The well closure assembly 40 is then disposed into the wellbore 14 using the manipulator arms 46, 48, as illustrated in FIG. 5. The pump 34 is actuated to flow fluid through the fluid outlet 38 and into conduit 42. The fluid will pass through the fitting 53, the hydraulic disconnect tool 52 and into the packer device 50 to inflate the packer element 54. As the packer element 34 is inflated, a fluid seal is formed between the packer device 50 and the wellbore 14, thereby closing it off (FIG. 6). As noted, the hydraulic disconnect running tool 52 will automatically release from the bridge plug 50 upon the injection of a predetermined amount of fluid pressure from the pump 34 via fluid conduit 42. Thereafter, the tool 52 is removed from the wellbore 14 (FIG. 7). The ROV 22 may then be guided back to the surface vessel 16.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A system for sealing off a subsea wellbore comprising:

a submersible remotely operated vehicle;

a well closure device having a packer device for sealing off the wellbore carried by said remotely operated vehicle;

a setting mechanism carried by the remotely operated vehicle to set the packer device, wherein the setting mechanism comprises a hydraulic disconnect running tool that is releasably secured to the packer device and disconnecting the packer device from the running tool within the wellbore following setting of the packer device.

2. The system of claim 1 wherein:

the packer device comprises an inflatable packer element; and the setting mechanism comprises a submersible fluid pump carried by the remotely operated vehicle.

3. The system of claim 2 further comprising a fluid conduit interconnecting the fluid pump with the running tool.

4. The system of claim 2 wherein the hydraulic disconnect running tool includes a latching assembly having a piston that is moveable within a piston chamber and wherein the latching assembly disconnects from the packer device upon receipt of a predetermined level of fluid pressure from the fluid pump into the piston chamber to shift the piston within the piston chamber and disconnect the latching assembly, leaving the wellbore sealed off by the packer device.

5. The system of claim 1 wherein the remotely operated vehicle further carries at least one manipulator arm for removing the well closure device from the remotely operated vehicle and disposing the well closure device within the wellbore.

6. A system for sealing off a subsea wellbore comprising:

a submersible remotely operated vehicle;

a packer device carried by said remotely operated vehicle, the packer device having an inflatable packer element for sealing off the wellbore, a packer body which carries the inflatable packer element, and a hydraulic disconnect running tool that is releasably secured to the packer device; and a setting mechanism carried by the remotely operated vehicle to selectively inflate the packer element to seal off the wellbore and disconnecting the packer device from the running tool within the wellbore following setting of the packer device.

7. The system of claim 6 wherein the setting mechanism comprises a fluid pump.

8. The system of claim 7 further comprising a fluid conduit that interconnects the running tool with the fluid pump.

9. The system of claim 7 wherein the hydraulic disconnect running tool includes a latching assembly having a piston that is moveable within a piston chamber and wherein the latching assembly disconnects from the packer device leaving the wellbore sealed off by the packer device, upon receipt of a predetermined level of fluid pressure from the fluid pump into the piston chamber to shift the piston within the piston chamber and disconnect the latching assembly.

10. The system of claim 6 further comprising a manipulator arm carried by the remotely operated vehicle for removing the well closure device from the remotely operated vehicle and disposing the packer device into the wellbore.

11. A method of sealing off a subsea wellbore, comprising the steps of:

launching into an area of sea a submersible remotely operated vehicle carrying a packer device for selectively sealing off the wellbore;

disposing the packer device into the wellbore;

actuating the packer device to seal off the wellbore; and actuating a hydraulic disconnect running tool to release the packer device from the running tool within the wellbore following setting of the packer device.

12. The method of claim 11 wherein the packer device includes:

a packer element that is moveable between unset and set positions;

the hydraulic disconnect running tool is releasably affixed to the packer element for selectively moving the packer element between unset and set positions; and the step of actuating the packer device further comprises the step of the running tool moving the packer element to its set position.

* * * * *